US011346109B1

(12) United States Patent
Borum et al.

(10) Patent No.: US 11,346,109 B1
(45) Date of Patent: May 31, 2022

(54) ROOF AND GUTTER CLIP

(71) Applicants: Erica Borum, Carbondale, CO (US); Mark R. Weinhold, Carbondale, CO (US)

(72) Inventors: Erica Borum, Carbondale, CO (US); Mark R. Weinhold, Carbondale, CO (US)

( * ) Notice: Subject to any disclaimer, the term of this patent is extended or adjusted under 35 U.S.C. 154(b) by 0 days.

(21) Appl. No.: 17/358,635

(22) Filed: Jun. 25, 2021

(51) Int. Cl.
*E04D 13/00* (2006.01)
*E04D 13/072* (2006.01)

(52) U.S. Cl.
CPC ..... *E04D 13/0722* (2013.01)

(58) Field of Classification Search
None
See application file for complete search history.

(56) References Cited

U.S. PATENT DOCUMENTS 272,925 A * 2/1883 Wilcox ..... E04D 13/0725 248/48.2
324,213 A * 8/1885 Berger ..... E04D 13/0725 248/48.2
538,108 A * 4/1895 Freeze ..... E04D 13/076 52/11
540,896 A * 6/1895 Berger ..... E04D 13/0725 248/48.2
1,414,345 A * 5/1922 Eeftink ..... E04D 13/0722 248/48.2
2,596,553 A * 5/1952 Henry ..... E04D 13/0722 248/48.1
3,091,055 A * 5/1963 Hegedusich ..... E04D 13/076 52/16
6,389,755 B1 * 5/2002 Wenner ..... E04D 13/064 248/48.1
7,591,441 B1 9/2009 Rossman
2002/0125377 A1 * 9/2002 Miller ..... E04D 13/0722 248/48.2
2006/0225377 A1 10/2006 Moriau et al.
2017/0138055 A1 5/2017 Gill
2019/0277032 A1 9/2019 Gori
2020/0040583 A1 2/2020 Gori

FOREIGN PATENT DOCUMENTS

CA 2493006 7/2006
GB 2541655 3/2017
JP H11200571 A * 7/1999
WO WO-8804534 A1 * 6/1988 ..... A47K 13/10

OTHER PUBLICATIONS https://www.homedepot.com/p/Amerimax-Home-Products-5-in-Hidden-Hangers-with-Straps-4-Pack-21030PK/100039308#product-overview.
https://images.homedepot-static.com/catalog/pdfImages/ee/ee1c5e7f-1379-49e1-8c06-15a34da40533.pdf.

* cited by examiner

*Primary Examiner* — Steven M Marsh
(74) *Attorney, Agent, or Firm* — Patent Law Clinic New York Law School

(57) ABSTRACT

A device for attaching a gutter to a house or other building that does not include a fascia board. The device includes a roof clip configured to be attached to a roof and a gutter clip configured to be releasably coupled to the roof clip and further configured to hold a gutter.

10 Claims, 3 Drawing Sheets

ROOF AND GUTTER CLIP

FIELD

The exemplary embodiments relate to a device, and more specifically a roof attachment that includes a hinge and hanger that allows a gutter to be attached to a corrugated roof or roofing structure that does not contain a fascia board.

BACKGROUND INFORMATION

There are a number of different devices used by the general public today to support gutters on homes containing fascia boards. Typically, a fastening device such as nails or screws are attached to the fascia board to attach the gutter to the home. However, many homes or other types of buildings (e.g., garages, storage sheds, etc.) do not have fascia board structures that allow for the attachment of a gutter. Because of this, many homes go without gutters, causing water erosion and damage to the homes themselves.

SUMMARY

Some exemplary embodiments are related to a device having a roof clip configured to be attached to a roof and a gutter clip configured to be releasably coupled to the roof clip and further configured to hold a gutter.

In some exemplary embodiments, the roof clip comprises a first portion of an adjustable locking hinge and the gutter clip comprises a second portion of the adjustable locking hinge, wherein the roof clip and gutter clip are releasably coupled using the adjustable locking hinge. In some exemplary embodiments, the adjustable locking hinge is configured to releasably couple the roof clip and the gutter clip over a range of angles with respect to each other. In some exemplary embodiments, the range of angles is 0-65 degrees.

In some exemplary embodiments, the roof clip has a body portion including two arms having a slit therebetween, wherein the slit is configured to receive roofing material to attach the roof clip to the roof. In some exemplary embodiments, the two arms are biased to hold the roofing material via a compression fit. In some exemplary embodiments, at least one of the arms includes a mechanism to secure the roof clip to the roofing material.

In some exemplary embodiments, the gutter clip comprises an arm portion configured to hold the gutter. In some exemplary embodiments, the arm portion includes a mechanism to secure the gutter clip to the gutter.

In some exemplary embodiments, the roof clip and the gutter clip are constructed of a thermoplastic material that is UV resistant. In some exemplary embodiments, the roof clip and the gutter clip are constructed of a metal material. In some exemplary embodiments, the roof clip and the gutter clip are constructed of a composite material.

In some exemplary embodiments, the roof clip is configured to attach to roofing material of the roof, wherein the roofing material is a corrugated metal, a corrugated fiberglass or shingles.

DETAILED DESCRIPTION

Figure 1:
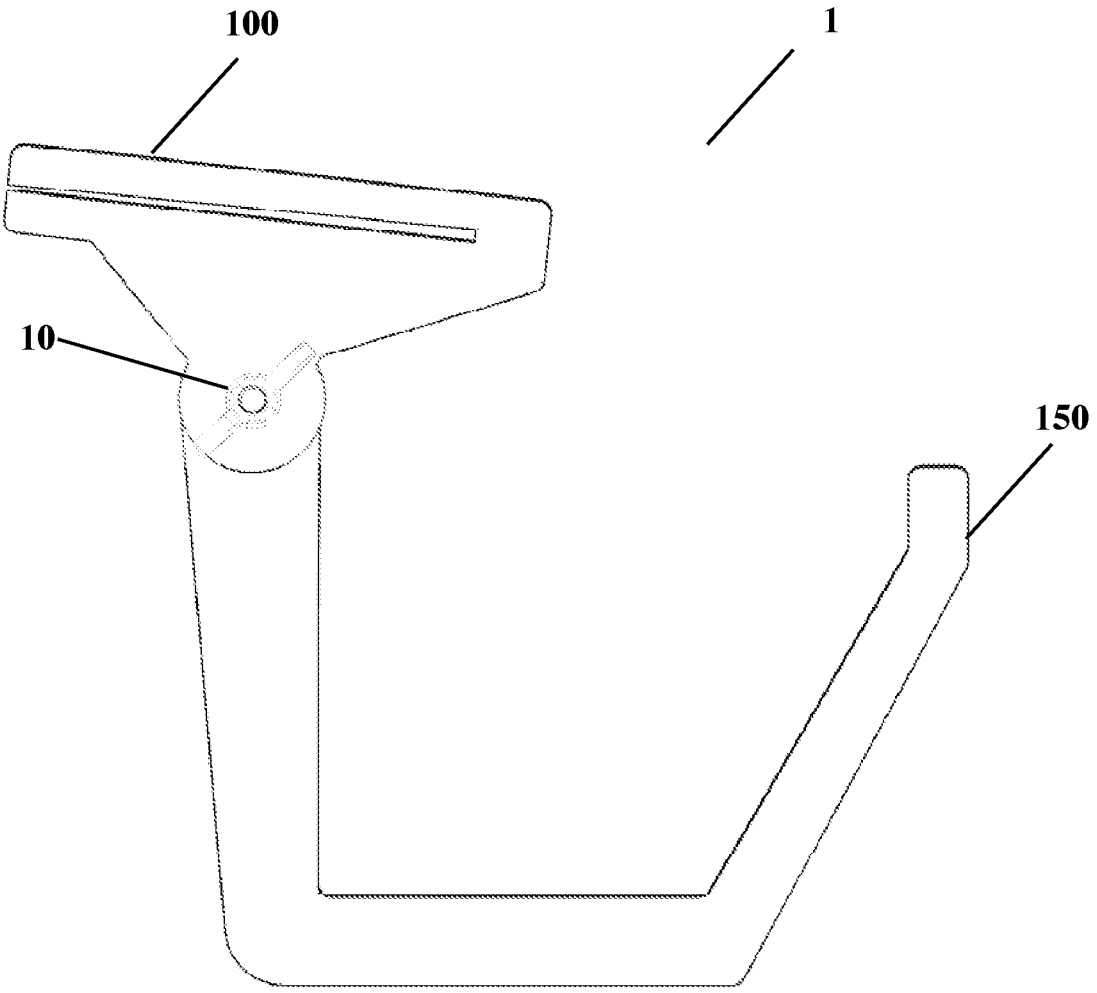
FIG. 1 shows a side view of an exemplary gutter system according to various exemplary embodiments.

The exemplary embodiments may be further understood with reference to the following description and the related appended drawings, wherein like elements are provided with the same reference numerals. The exemplary embodiments describe a device, which includes two components configured to be attached to a corrugated roof and support a gutter when used together. The exemplary embodiments may be a device configured to be attached to a corrugated roof or any roofing structure of a home or building that does not include a fascia board.

FIG. 1 shows a side view of an exemplary gutter system 1 according to various exemplary embodiments. The gutter system 1 comprises a roof clip 100 and a gutter clip 150, each of which will be described in greater detail below. The roof clip 100 is configured to attach to a roof rather than attaching to a fascia board. As will be described below, the roof may be any type of roof, e.g., a corrugated metal roof, a corrugated fiberglass roof, a shingle roof, etc. The gutter clip 150 is configured to attach to the roof clip 100 and is also configured to hold a gutter.

The roof clip 100 and a gutter clip 150 may be constructed of any type of material that may withstand the outdoor elements and is strong enough to support a gutter. In some exemplary embodiments, the roof clip 100 and a gutter clip 150 may be constructed of a thermoplastic that is UV resistant and rigid enough to support a gutter. In other exemplary embodiments, metal or composite materials may be used.

Figure 2A:
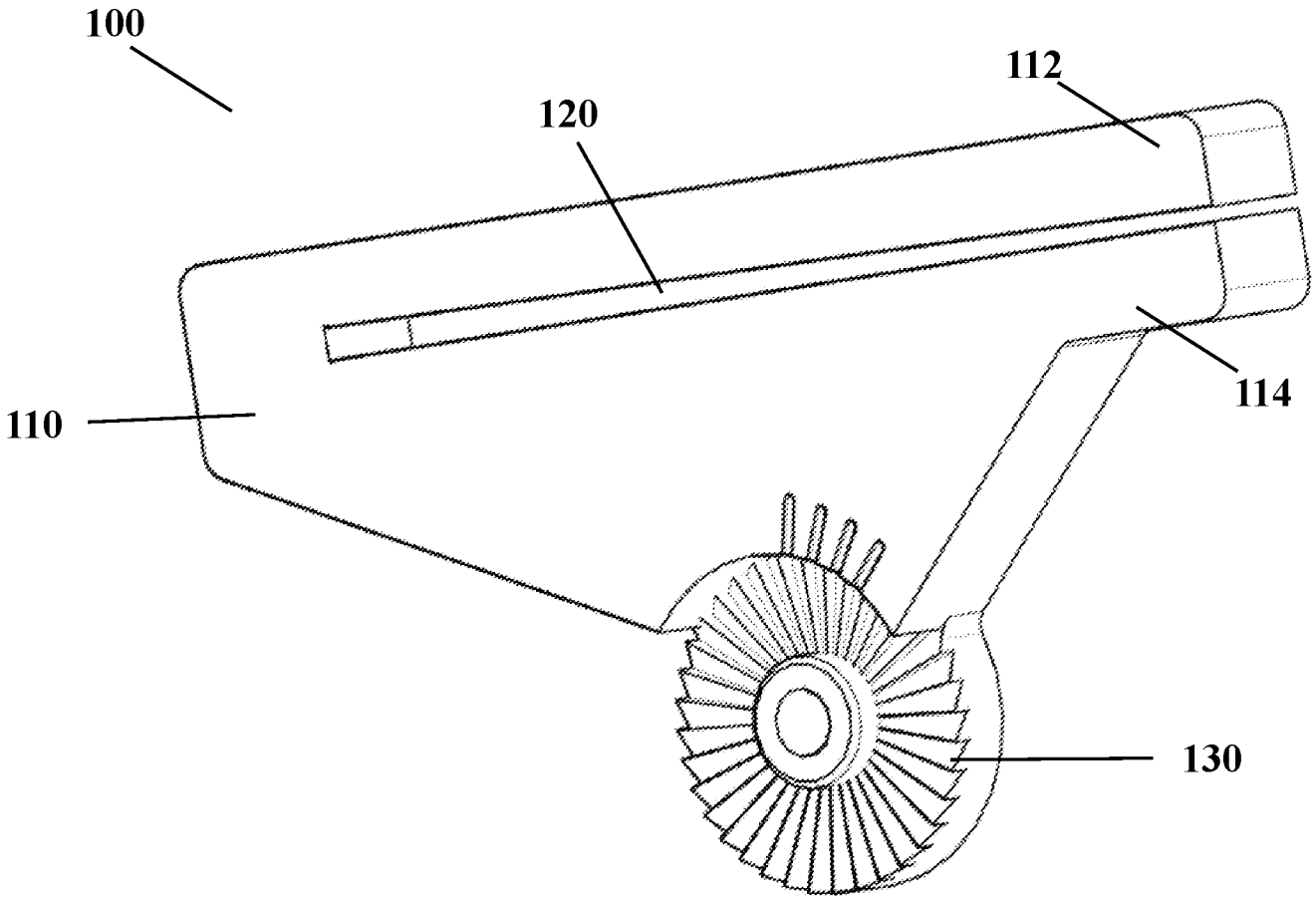
FIG. 2A shows a perspective view of an exemplary roof clip of the exemplary gutter system according to various exemplary embodiments.

FIG. 2A shows a perspective view of an exemplary roof clip 100 of the exemplary gutter system 1 according to various exemplary embodiments. The roof clip 100 includes a body portion 110 that comprises a first arm 112 and a second arm 114. The first and second arms 112 and 114 form a slit 120 that runs from an edge of the roof clip 100 towards an opposite edge of the roof clip 100 such that the slit 120 forms an opening in the roof clip 100. In the example of FIG. 2A, the slit 120 extends approximately seven eighths of the length of the roof clip 100. However, it should be understood that the slit 120 may extend more or less than shown in the example of FIG. 2A.

The purpose of the slit 120 is that the roof clip 100 may be slipped onto a bottom portion of a roof. For example, if the roof is constructed of a corrugated metal or fiberglass, the slit 120 may be configured to receive the corrugated metal or fiberglass between the two arms 112 and 114 to secure the roof clip 100 to the roof. In another example, if the roof is constructed of a sheathing (e.g., plywood or other material) that is covered by shingles, the slit 120 may be configured to receive a shingle between the two arms 112 and 114 to secure the roof clip 100 to the roof.

In some exemplary embodiments, when the roofing material is received in the slit 120 between the two arms 112 and 114, the roof clip 100 may be secured to the roof by compression. For example, the width of the slit 120 may be sized (e.g., the arms 112 and 114 may be biased) such that to insert the roofing material into the slit may require the slit 120 to be opened slightly for insertion. When the roofing material is fully inserted, the compression force of the two arms 112 and 114 coming back together may hold the roof clip 100 to the roofing material. The width of the slit 120 being sized for the compression fit may be the entire length of the slit 120 or may also be in a particular location of the slit. For example, in some exemplary embodiments, the inside of the arms 112 and 114 that form the slit 120 may have ridges or teeth (e.g., similar to the ridges/teeth of a vise grip) that are used to grip the roofing material when using the compression force. The ridges may be, for example, located near the open edge of the slit 120 and this may be the portion of the arms 112 and 114 that are opened to accept the roofing material and then provide the compression force to hold the roof clip 100 to the roof.

In other exemplary embodiments, either or both of the arms 112 and 114 may include a mechanism for a fastener to be inserted into the roofing material to hold the roof clip 100 to the roof. For example, the arms 112 and/or 114 may include a hole such that a sheet metal screw or a wood screw (depending on the type of roofing) may be inserted through the hole and attached to the roofing material to secure the roof clip 100 to the roof.

The roof clip 100 also includes a first portion of an adjustable locking hinge 130. As will be described below in greater detail, the first portion of the adjustable locking hinge 130 will mate with a second portion that is included on the gutter clip 150 to releasably couple the roof clip 100 to the gutter clip 150. As shown in this figure, the first portion of the adjustable locking hinge 130 has ridges that face in a first direction. The second portion that is included on the gutter clip 150 will have ridges in an alternating direction to lock the components together. The adjustable locking hinge 130 allows the roof clip 100 to be releasably coupled to the gutter clip 150 over a range of angles. This allows the gutter system 1 to be attached to roofs that are pitched at a variety of angles. In some exemplary embodiments, the relationship between the roof clip 100 and the gutter clip 150 is over a range of angles from 0-65 degrees.

In the example of FIG. 2A, the roof clip 100 is shown as having an exemplary shape. However, it should be understood that the shape is only exemplary and that a roof clip that performs the functionality described herein may take on a variety of shapes. In addition, the exemplary roof clip 100 is shown as a singular integrated piece. This may be advantageous if the roof clip 100 is constructed by injection molding of a thermoplastic material. However, in other exemplary embodiments, the roof clip 100 may be constructed from more than one piece of material, e.g., the adjustable locking hinge 130 may be attached to the remainder of the roof clip 100 via a mechanical fastener or welding.

Figure 2B:
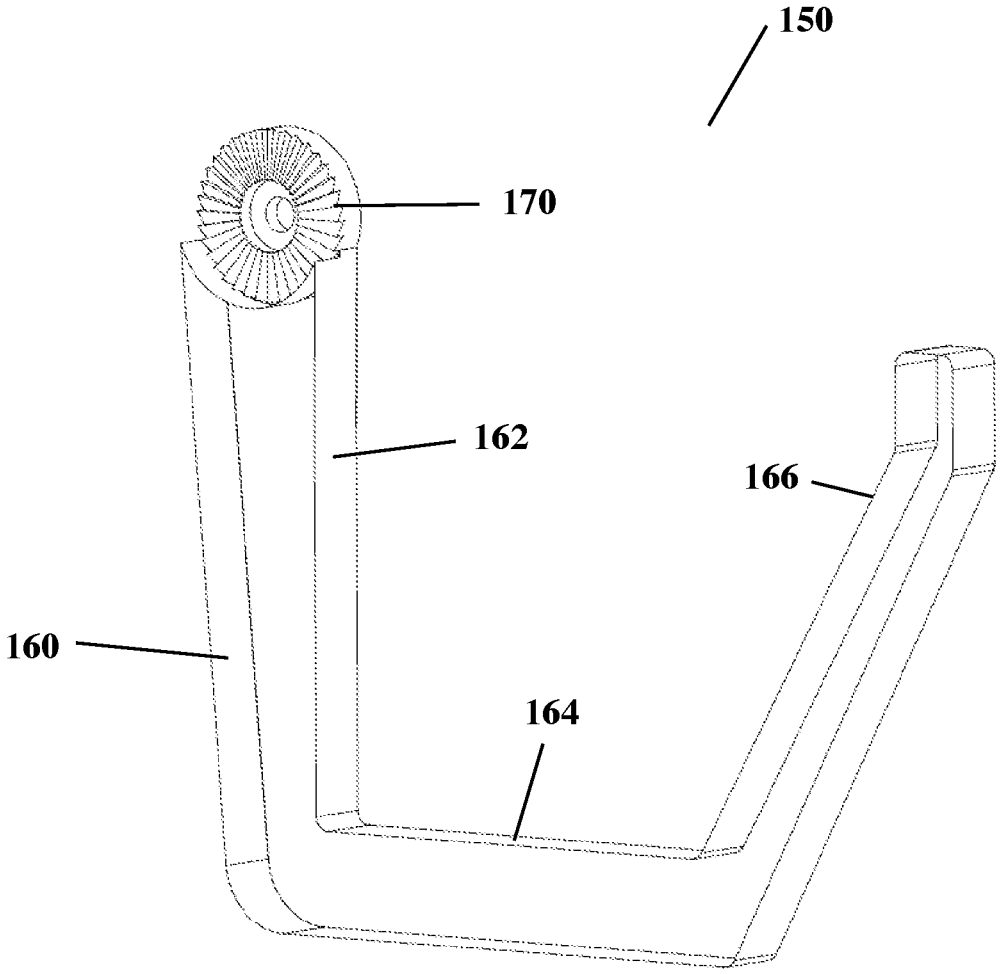
FIG. 2B shows a perspective view of an exemplary gutter clip of the exemplary gutter system according to various exemplary embodiments.

FIG. 2B shows a perspective view of an exemplary gutter clip 150 of the exemplary gutter system 1 according to various exemplary embodiments. The gutter clip 150 includes an arm portion 160 that is configured to hold the gutter. For example, the arm portion 160 may be shaped such that the gutter may be placed inside the arm portion to securely hold the gutter. For example, the arm portion may include an inside inner face 162, a bottom inner face 164 and an outside inner face 166 against which the gutter may rest when the gutter system 1 is in place.

It is again noted that the shape of the arm portion 160 in FIG. 2B is only exemplary, e.g., the shape shown in FIG. 2 corresponds to a commonly seen gutter shape. However, the arm portion 160 may take on any shape according to the shape of the gutter that is to be received and held in the arm portion 160. For example, if the gutter is shaped like a half cylinder, the arm portion 160 may be shaped as an arc that approximates the half cylinder. In other exemplary embodiments, the arm portion 160 may have a universal shape such as an open rectangle that may accept various shaped gutters.

In some exemplary embodiments, the arm portion 160 may include a mechanism for a fastener to be inserted into the gutter to secure the gutter to the gutter clip 150 when the gutter is received in the arm portion 160. For example, the arm portion 160 may include a hole such that a sheet metal screw may be inserted through the hole and attached to the gutter to secure the gutter to the gutter clip 150. However, such a mechanism is not required because the shape of the arm portion 160 may be sufficient to securely hold the gutter within the gutter clip 150.

The gutter clip 150 also includes a second portion of an adjustable locking hinge 170. As described above, the second portion of the adjustable locking hinge 170 of the gutter clip 150 will mate with the first portion of the adjustable locking hinge 130 of the roof clip to releasably couple the roof clip 100 to the gutter clip 150. The adjustable locking hinge 130/170 allows the roof clip 100 to be releasably coupled to the gutter clip 150 over a range of angles. This allows the gutter system 1 to be attached to roofs that are pitched at a variety of angles.

Similar to the roof clip 100, the exemplary gutter clip 150 is shown as a singular integrated piece. This may be advantageous if the gutter clip 150 is constructed by injection molding of a thermoplastic material. However, in other exemplary embodiments, the gutter clip 150 may be constructed from more than one piece of material, e.g., the adjustable locking hinge 170 may be attached to the remainder of the gutter clip 150 via a mechanical fastener or welding.

Returning to FIG. 1, it should now be understood that FIG. 1 shows the assembled gutter system 1 where the roof clip 100 has been releasable secured to the gutter clip 150. As shown in the example of FIG. 1, the roof clip 100 and gutter clip 150 are connected using a screw and wing nut 10 that are inserted through the first portion of the adjustable locking hinge 130 and the second portion of the adjustable locking hinge 170 and tightened. The example of FIG. 1 shows the roof clip 100 and gutter clip 150 releasably coupled at a first exemplary angle. However, those skilled in the art will understand that the use of the adjustable locking hinge 130/170 allows the roof clip 100 and gutter clip 150 to be connected over a wide range of angles.

The following will provide an example of a use case for the gutter system 1. In this example, it may be considered that the roof is a corrugated metal roof and that one side of the roof has a length of 10 feet. Again, this is only exemplary and is intended to provide an example use of the gutter system 1. In this example, it may be considered that each individual gutter system 1 device should be placed 2 feet from the other gutter system 1 devices. However, this is only exemplary and other distances may be used (e.g., 1 foot, 18 inches, 30 inches, etc.). Thus, in this example, six (6) gutter system 1 devices will be attached to the roof (e.g., 0 ft, 2 ft, 4 ft, 6 ft, 8 ft and 10 ft).

Each gutter system 1 device may have the roof clip 100 and the gutter clip 150 loosely attached to each other. The roof clip 100 may then be secure to the corrugated metal roof in the manner described above, e.g., the corrugated metal roof is received in the slit 120 of the roof clip 100 to secure the roof clip 100 to the roof. The gutter clip 150 may then be moved into a rough position to hold the gutter, e.g., the gutter clip 150 may be placed such that the bottom inner face 164 is roughly parallel with the ground (assuming the ground is flat) and the gutter clip 150 may be more securely attached to the roof clip 100 by tightening the screws that hold the adjustable locking hinge 130/170. This position may not be the final position as angle may be adjusted as described below.

The gutter may then be placed into the gutter clip 150. The angle of the gutter with respect to the roof may then be adjusted using the adjustable angles of the adjustable locking hinge 130/170. This allows the gutter to catch as much water as possible. Again, this installation process is only exemplary and other installation processes may be used.

Although this application described various aspects each having different features in various combinations, those skilled in the art will understand that any of the features of one aspect may be combined with the features of the other aspects in any manner not specifically disclaimed or which is not functionally or logically inconsistent with the operation of the device or the stated functions of the disclosed aspects.

It will be apparent to those skilled in the art that various modifications may be made in the present disclosure, without departing from the spirit or the scope of the disclosure. Thus, it is intended that the present disclosure cover modifications and variations of this disclosure provided they come within the scope of the appended claims and their equivalent.

What is claimed is:

1. A device, comprising:

a roof clip comprising a body portion including two arms, wherein the first and second arms form a slit that is configured to be attached to a roof, wherein the two arms are biased to hold a roofing material via a compression fit, and wherein said roof clip comprises a first portion of an adjustable locking hinge; and a gutter clip that comprises a second portion of the adjustable locking hinge, wherein the roof clip and gutter clip are releasably coupled using the adjustable locking hinge.

2. The device of claim 1, wherein the adjustable locking hinge is configured to releasably couple the roof clip and the gutter clip over a range of angles with respect to each other.

3. The device of claim 2, wherein the range of angles comprises 0-65 degrees.

4. The device of claim 1, wherein at least one of the arms includes a mechanism to secure the roof clip to the roofing material.

5. The device of claim 1, wherein the gutter clip comprises an arm portion configured to hold the gutter.

6. The device of claim 5, wherein the arm portion includes a mechanism to secure the gutter clip to the gutter.

7. The device of claim 1, wherein the roof clip and the gutter clip are constructed of a thermoplastic material that is UV resistant.

8. The device of claim 1, wherein the roof clip and the gutter clip are constructed of a metal material.

9. The device of claim 1, wherein the roof clip and the gutter clip are constructed of a composite material.

10. The device of claim 1, wherein the roof clip is configured to attach to roofing material of the roof, wherein the roofing material comprises one of a corrugated metal, a corrugated fiberglass or shingles.

* * * * *